United States Patent [19]

Dudzik

[11] Patent Number: 4,700,614

[45] Date of Patent: Oct. 20, 1987

[54] STRIP VENTILATOR

[75] Inventor: Henryk Dudzik, Mansfield, England

[73] Assignee: R. W. Simon Limited, Torrington, England

[21] Appl. No.: 828,893

[22] Filed: Feb. 12, 1986

[30] Foreign Application Priority Data

Feb. 19, 1985 [GB] United Kingdom ..... 8504205

[51] Int. Cl.[4] ..... E06B 7/082

[52] U.S. Cl. ..... 98/98; 49/38

[58] Field of Search ..... 49/38; 98/37, 41.3, 98/88.1, 98, 99.01, 99.6; 403/331, 381

[56] References Cited

U.S. PATENT DOCUMENTS

| | | | |
|---|---|---|---|
| 1,528,988 | 3/1925 | Platts et al. | 403/331 |
| 1,728,777 | 9/1929 | Trier | 98/98 X |
| 4,027,581 | 6/1977 | Yamamoto | 98/98 |
| 4,512,244 | 4/1985 | Knaap | 98/98 |

FOREIGN PATENT DOCUMENTS

| | | | |
|---|---|---|---|
| 1946617 | 3/1971 | Fed. Rep. of Germany | 98/98 |
| 779411 | 7/1957 | United Kingdom | 403/331 |

*Primary Examiner*—Harold Joyce

*Attorney, Agent, or Firm*—Quaintance, Murphy & Presta

[57] ABSTRACT

Ventilating apparatus comprises an elongate component (10) having complementary formations (19,20) at opposite ends whereby the component is adapted to be interlocked end to end in series with another component (10) or other components (10) and/or a connecting member (59,60) or connecting members (59,60). The component (10) and connecting members (59,60) therefore provide a modular system comprising one or more standard units (10) with left hand and/or right connecting members (59,60) enabling any combination to be connected end to end in series and thereby fit any size window.

12 Claims, 13 Drawing Figures

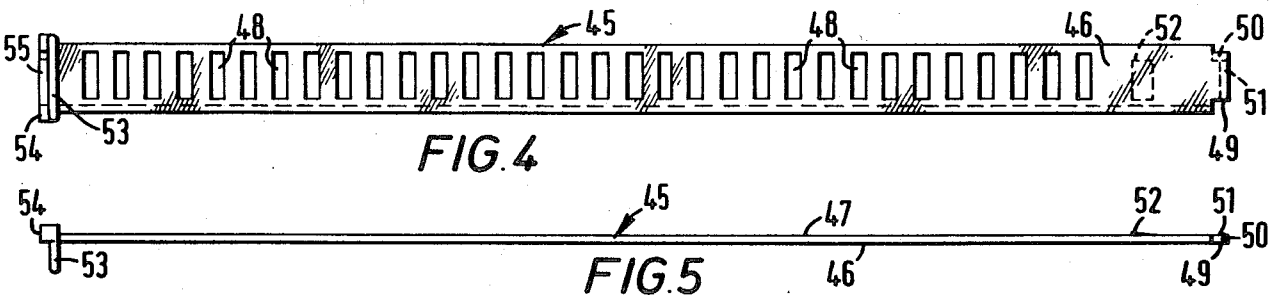
FIG. 4
FIG. 5
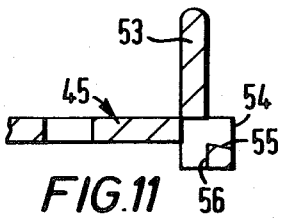
FIG. 11
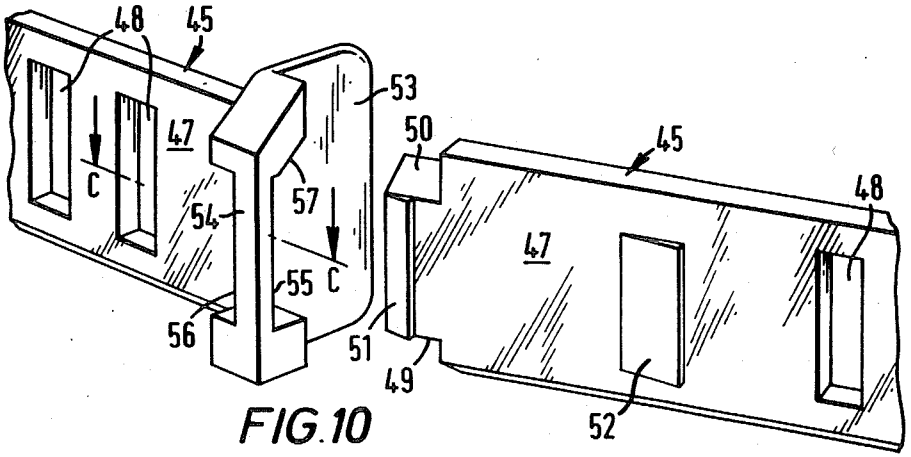
FIG. 10

STRIP VENTILATOR

This invention relates to ventilating apparatus.

It is known to provide ventilating apparatus of an elongate configuration adapted for location adjacent a longitudinal marginal edge portion of a glazed panel whereby, when the panel is mounted in a window frame, the ventilating apparatus extends in a direction transversely of the window frame adjacent an upper transverse portion of the frame. An example of such apparatus is disclosed in United Kingdom patent specification No. 714 897.

Such apparatus generally comprises a plurality of components comprising an elongate body portion having an inlet for the passage of air therethrough, a locating device for engaging a glazed panel and a cowl for controlling flow of air to the inlet, all of the components being manufactured by machining materials and the components then being assembled to form ventilating apparatus. The cost of manufacture of the numerous components and of subsequent assembly of the components to provide each complete ventilating apparatus is the largest contributory factor of the cost of the apparatus.

Apart from the cost of manufacture of numerous components for each ventilating apparatus, it is necessary to provide such apparatus in different lengths suitable for different size windows. The necessity of having to provide a range of different lengths of such apparatus also contributes to the cost of manufacture.

The disadvantages referred to above are overcome in the present invention because the invention is characterised in that the elongate body portion of such apparatus is provided with connecting means for connecting the body portion to another elongate component whereby the components extend end to end in series.

With such an arrangement, a plurality of identical modular units may be provided which may be connected together one with another and with one or more modular connecting members also having such connecting means and thereby fit any size window. Alternatively, one such unit if necessary connected together with one or two such connecting members may be sufficient for a particular size window. It may be necessary to cut the or each connecting member to size.

The invention also provides for an elongate shutter for controlling passage of air through the inlet, the shutter being provided with connecting means for connecting the shutter end to end in series with a shutter of another similar apparatus whereby operation of one said shutter effects operation of the other said shutter.

However, if permanent ventilation is required, location of the shutter is such that the shutter easily can be removed.

Another characteristic of the invention is that the cowl is provided with an inlet arranged such that the inlet of the body portion is located above and to the rear of the inlet of the cowl thereby ensuring no direct wind pass.

The connection means of the body portion and of the or each connecting member is provided with a formation which, when connected with a complementary connecting member of another body portion, provides a capillary break which prevents ingress of liquid by capillary action.

The formation is such as to provide for a dovetail connecting action with the complementary connecting member and can be manufactured by injection moulding without need for sliding mould parts.

Unlike with ventilating apparatus known hitherto, the invention is characterised is that the body portion, the locating device and the cowl are formed as a single component. In this manner, the cost of manufacture of numerous components, as with apparatus known hitherto, is eliminated.

In order that the single component may be assembled to provide ventilating apparatus, the body portion and the cowl are provided with complementary formations which are interengageable to effect location of the cowl relative to the body portion, the cowl and body portion being united one with another by means of hinges integral with the cowl and body portion.

The body portion is elongate and comprises a chamber. The chamber thereby provides a box configuation which reduces distortion of the ventilating apparatus to a minimum.

The ventilating apparatus according to the invention is formed of plastics material by injection moulding.

Following is a description, by way of example only and with reference to the accompanying drawings, of one method of carrying the invention into effect.

In the drawings:

FIG. 4 is a plan view of a slide adapted to co-operate with the component.

FIG. 5 is an elevation of the slide,

FIG. 10 is a diagrammatic perspective view showing interengagement end to end of two adjacent slides, FIG. 11 is a cross section on the line C—C of FIG. 10.

Figure 1:
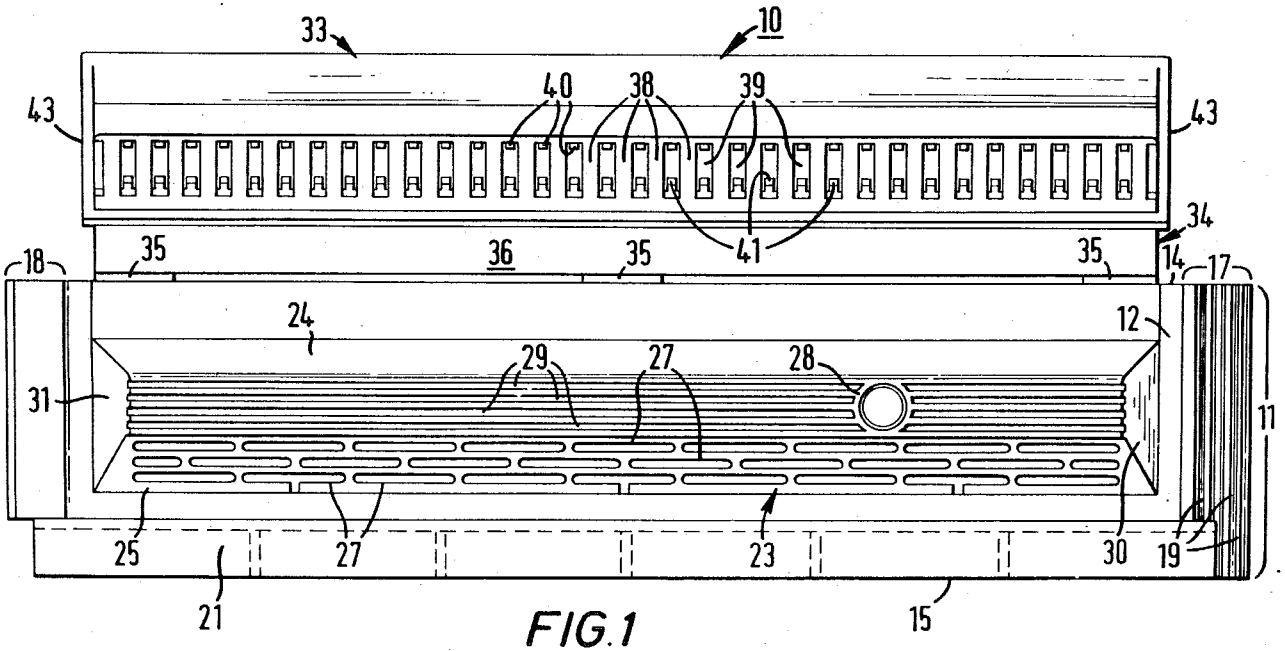
FIG. 1 is a plan view of a component prior to assembly to form ventilating apparatus in accordance with the present invention.
Figure 2:
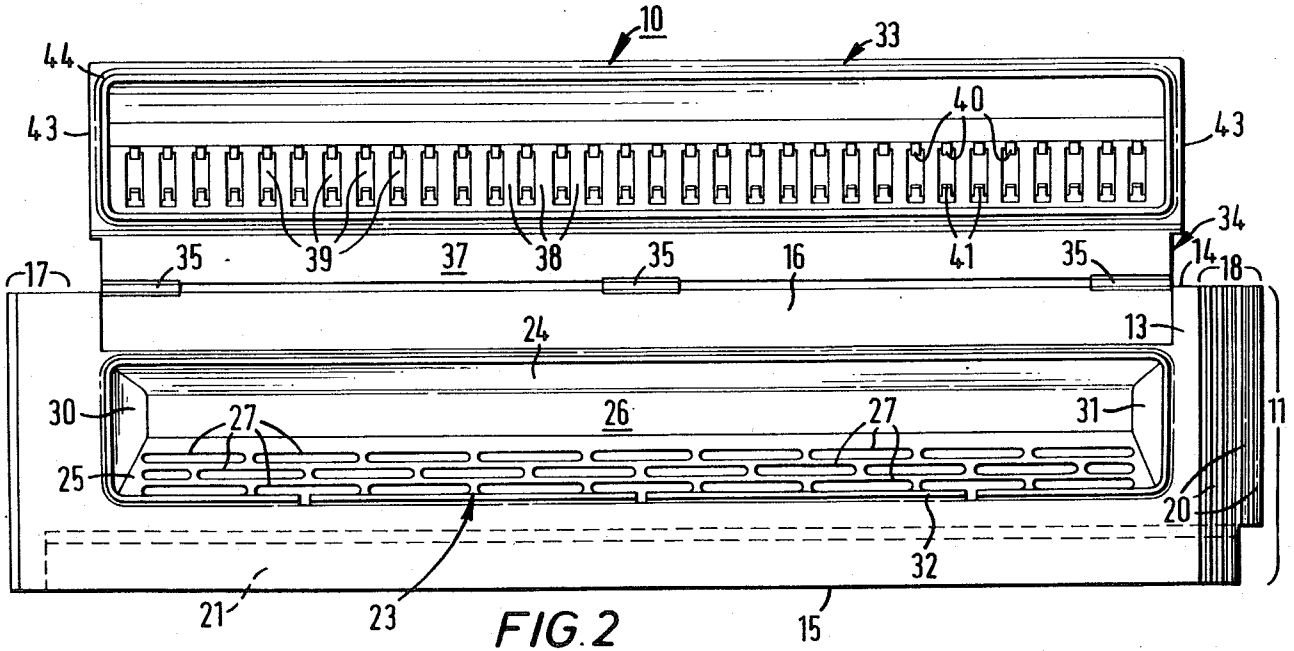
FIG. 2 is a plan view of a rear of the component shown in FIG. 1.

Referring now to FIGS. 1 and 2 of the drawings, there is shown a component 10 formed as a single piece of plastics material by injection moulding. The component comprises an elongate rectangular lamina 11 having a front surface 12, a rear surface 13, an upper edge 14 and a lower edge 15. The rear surface 13 of the lamina 11 is provided with an elongate recess 16 extending longitudinal of the lamina 11 adjacent the upper edge 14. The longitudinal dimension of the lamina 11 is greater than the longitudinal dimension of the recess 16 providing opposite end portions 17,18 extending in opposite directions beyond the adjacent ends of the recess 16. The end portion 17 is provided on a front surface thereof with a plurality of parallel formations 19 extending transversely of the lamina 11. The end portion 18 is provided on a rear surface thereof with a plurality of parallel formations 20 extending transversely of the lamina 11. The formations 19 are complementary to the formations 20.

The front surface 12 of the lamina 11 is provided with an integral channel portion 21 extending adjacent and longitudinally of the lower edge 15 of the lamina 11, the channel being open from below thereby providing an elongate recess 22.

Also formed integrally with the lamina 11 is an elongate cowl 23 having an upper wall 24, a lower wall 25 and an outer wall 26. The upper and lower walls 24, 25 converge forwardly of the front surface 12 of the lamina 11 towards the outer wall 26 and the lower wall is provided with a plurality of elongate slots 27 extending in parallel rows, the longitudinal axes of the slots 27 being parallel one to another and to a longitudinal axis of the lamina 11. The outer wall 26 is provided with a plurality of spaced parallel grooves 29 on an outer surface 28 thereof, the grooves 29 extending parallel to a longitudinal axis of the cowl 23. The cowl 23 is provided with end walls 30, 31 which converge towards one another and towards the outer wall 26. The lamina 11 is provided with a formation 32 extending circumferentially of the cowl 23.

The lamina 11 is formed integrally with an elongate chamber 33 having a longitudinally extending web 34 projecting laterally from a longitudinal side thereof, the web 34 being connected to the lamina 11 by means of integral hinges 35 located adjacent the upper edge 14 of the lamina 11 adjacent the recess 16. The web 34 has an outer surface 36 and a rear surface 37. The chamber 33 comprises a wall 38 extending in a direction outwardly from the upper surface 36 of the web 34 and in a direction away from the hinges 35. The wall 38 is provided with a series of elongate rectangular apertures 49 the longitudinal axes of which extend parallel one to another and transversely of the chamber 33. The wall 38 has formed integrally therewith a plurality of pairs of lugs 40, 41, each pair extending in opposite directions from opposite ends of corresponding apertures 39 inwardly of the chamber thereby defining a passageway 42 below the apertures 39. The chamber 33 comprises end walls 43 each having a slot adjacent the passageway 42.

The chamber 33 is provided with a circumferential rectangular base formation 44 which is complementary to the formation 32 of the lamina 11.

Figure 3:
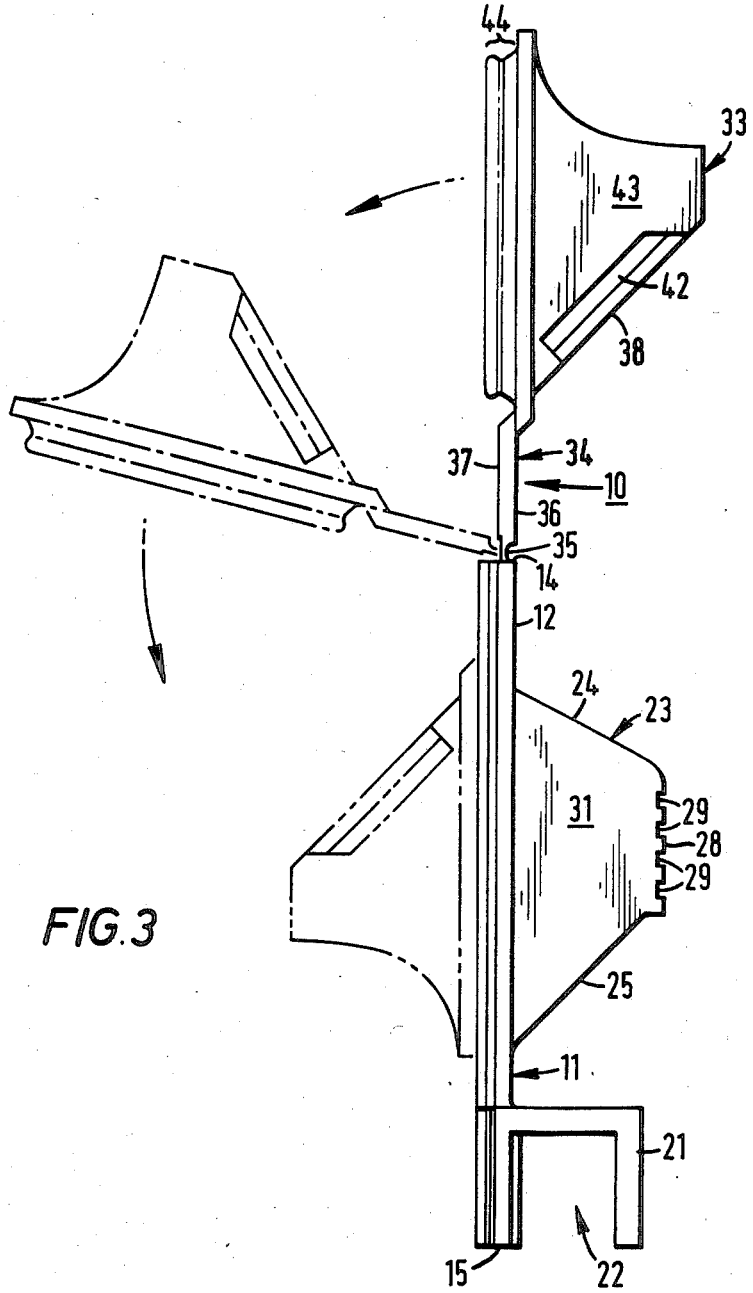
FIG. 3 is an end elevation of the component indicating, in chain dotted lines, the manner in which the component is assembled to form the ventilating apparatus.
Figure 8:
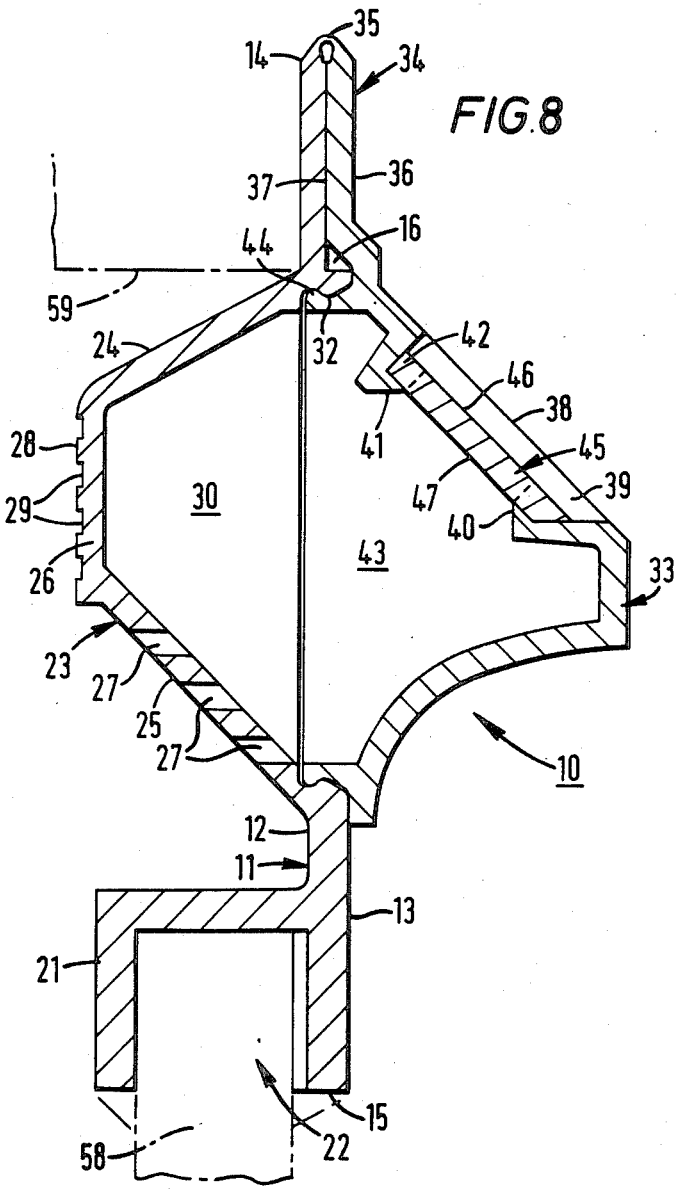
FIG. 8 is a cross-section on the line A—A of FIG. 7.

Referring now to FIGS. 3 and 8 of the drawings, the component 10 is assembled by pivoting the chamber 33 at the hinges 35 so that the rear wall 37 of the web 34 moves towards the recess 16 of the lamina 11, as shown in chain dotted lines in FIG. 3. The complementary formations 32 and 44 are such that, when the cowl 23 and the chamber 33 are urged towards one another in back-to-back configuration, the formations 32, 44 engage one another and snap together to maintain the back-to-back assembly of the cowl 23 and the chamber 33, as shown in FIG. 8.

Referring now to FIGS. 4 and 5 of the drawings, there is shown an elongate slide 45 for use with the component 10 comprising a front surface 46 and a rear surface 47, the slide being provided with a series of elongate rectangular apertures 48 each having a dimension corresponding substantially with each of the apertures 39 and the longitudinal axes of the apertures 48 extending transversely of a longitudinal axis of the slide 45. An end portion of the slide 43 is provided with a tongue 49 of reduced transverse dimension having an upper rearward downwardly sloping surface 50. The rear surface 47 of the slide 45 is provided with a first wedge portion 51 which is located at the rear of the tongue 49 and a second wedge portion 52 which is located in spaced relation to the tongue 49.

The slide 45 has formed integrally therewith at an end portion thereof from the tongue 49 with a flange 53 extending forwardly of the front surface 46 of the slide 45 and a rearwardly extending post 54 having a front chamfered surface 55 complementary to the inclined surface of the first wedge portion 51 and an inner abutment surface 56. The post 54 also is provided with an upper rearwardly downwardly inclined surface 57.

The slide 45 is inserted longitudinally through the slots in the end walls 43 of the chamber 33 and longitudinally of the passageway 42, as shown in FIG. 8, the front surface 46 of the slide 45 sliding in contact with the lugs 40,41. The dimensions of the second wedge portion 52 are such that the inclined surface of the second wedge portion 52 slides in contact with an opposite facing surface of the chamber 33 when the slide 45 is first inserted longitudinally of the passageway 42 but, when moved in an opposite direction of the passageway 42, the second wedge portion 52 snaps into engagement with an adjacent aperture 39 of the chamber 33 thereby restraining any further movement of the slide 45 in the opposite direction. In consequence, when the slide 45 is inserted fully in a longitudinal direction of the passageway 42, movement of the slide 45 in a reverse direction is restricted to the distance between adjacent apertures 48, the distance also corresponding to the distance between adjacent apertures 39 of the chamber 33. The slide 45 may be moved between an "open" position in which the apertures 48 of the slide 45 are in register with the apertures 39 of the chamber 33 and a "closed" position in which the apertures 39 of the chamber 33 are occluded by the portions of the slide 45 between adjacent apertures 48 thereof.

In use, the component 10 having the slide 45 mounted therein is located relative to a marginal edge portion of a glazed panel 58 by locating the component 10 such that the marginal edge portion of the glazed panel 58 is received in the channel portion 21 and an upper portion of the front surface 12 of the lamina 11 above the cowl 23 abuts an adjacent surface of a portion of a window frame 59, as shown in FIG. 8.

Figure 6:
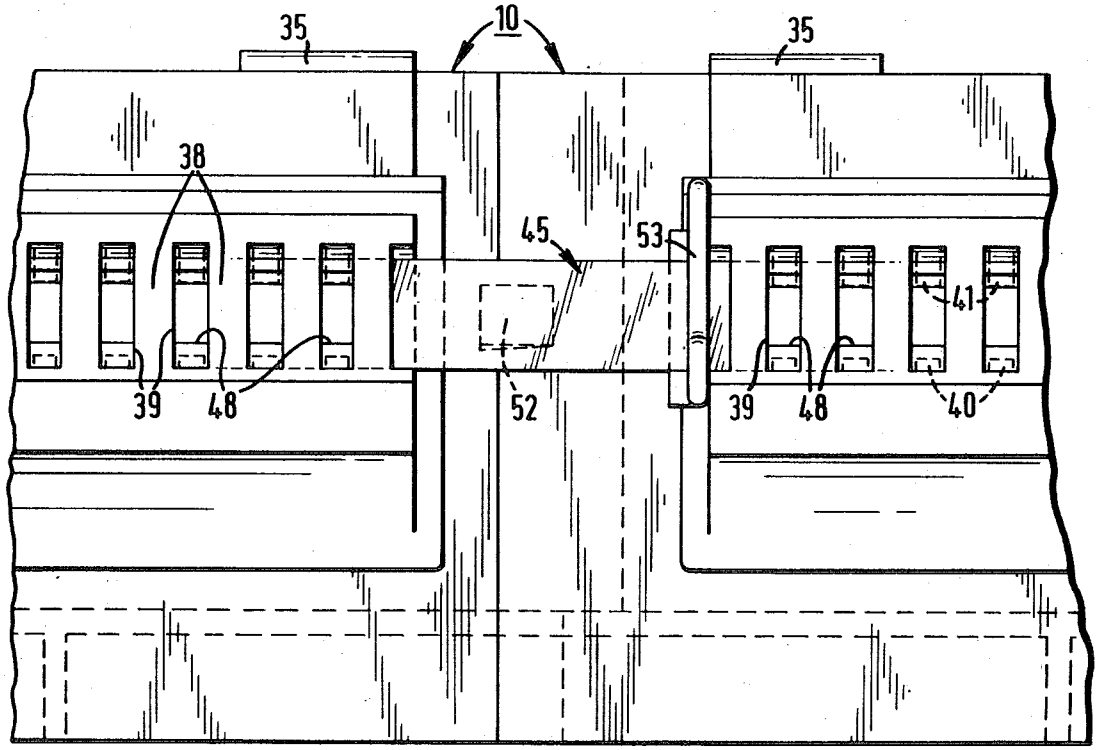
FIG. 6 is a diagrammatic elevation of the inside of two assembled components, each being provided with a slide, the components and slides being interconnected and the slides being positioned so as to open apertures of the components.
Figure 7:
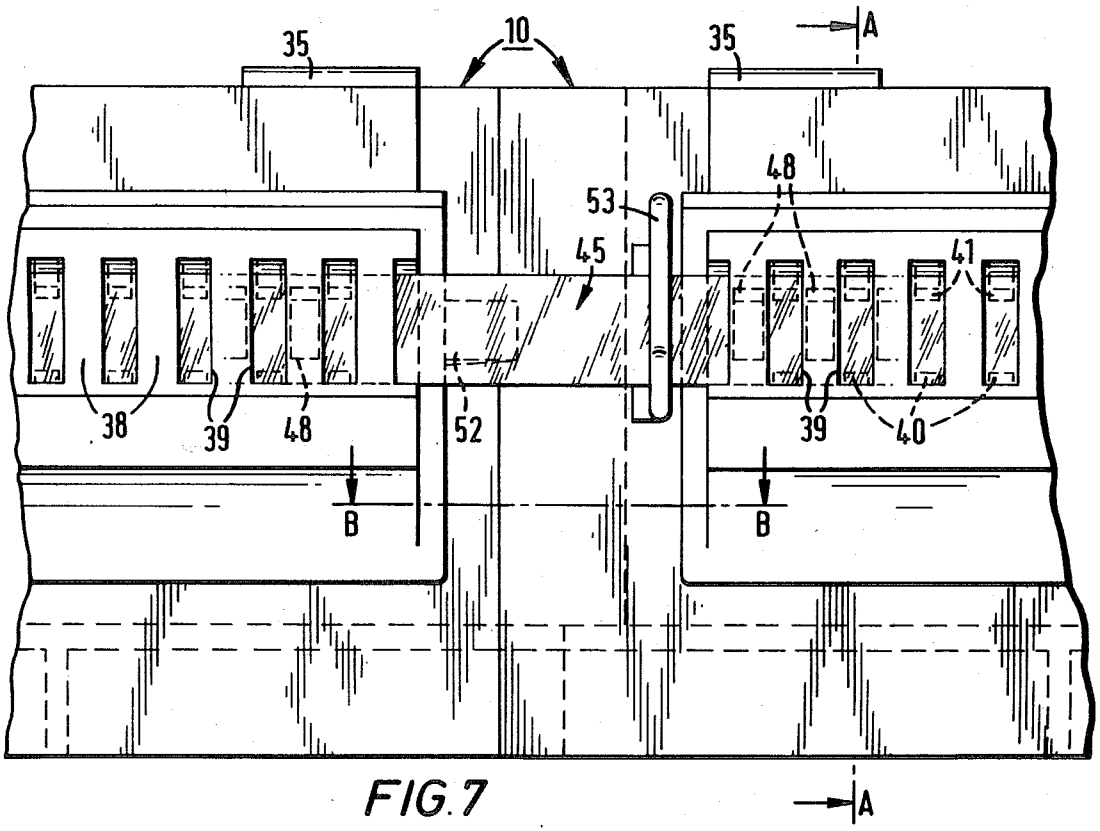
FIG. 7 is a view similar to FIG. 6, the slides being positioned so as to close the apertures.

The end portions 17, 18 will either have been sawn off or, if the component 10 were to be connected end to end with one or two additional components 10, one or neither of the end portions 17, 18 will have been removed. Instead, the components 10 will be connected one to another end to end by the corresponding formations 19, 20, as shown in FIGS. 6, 7. With such an arrangement, the slides 45 of the components 10 with similarly be connected end to end in the manner shown in FIG. 10.

Referring to FIG. 10, a tongue 49 of the slide 45 of one component 10 is moved longitudinally thereof towards the post 54 of the slide 45 of an adjacent component 10 such that the first wedge portion 51 slides over the front chamfered surface 55 of the post 54 and subsequently snaps into abutment with the abutment surface 56 of the post. The adjacent slides 45 thereby are secured end to end one with another.

It will be appreciated, therefore, that movement of a slide in a longitudinal direction in such a combination of components 10 will effect simultaneous longitudinal movement of each corresponding slide 45 connected therewith.

It will be appreciated that, in use, a slide 45 passes through the slots 27 in the lower wall 25 of the cowl 23 into and from the chamber 33 and control of air flow into and from an inner space bounded by the outer surface 36 of the web 34 and the rear surface 13 of the lamina 11 is controlled by longitudinal movement of the slide 45 or slides 45 between the "open" and "closed" positions.

It will also be appreciated that, if permanent ventilation is required, the or each slide 45 may be removed from the or each component 10.

Furthermore, it will be appreciated that the outlet of the chamber 33 provided by the apertures 39 is above and to the rear of the inlet of the cowl 23 provided by the slots 27 thereby ensuring no direct wind pass.

Figure 12:
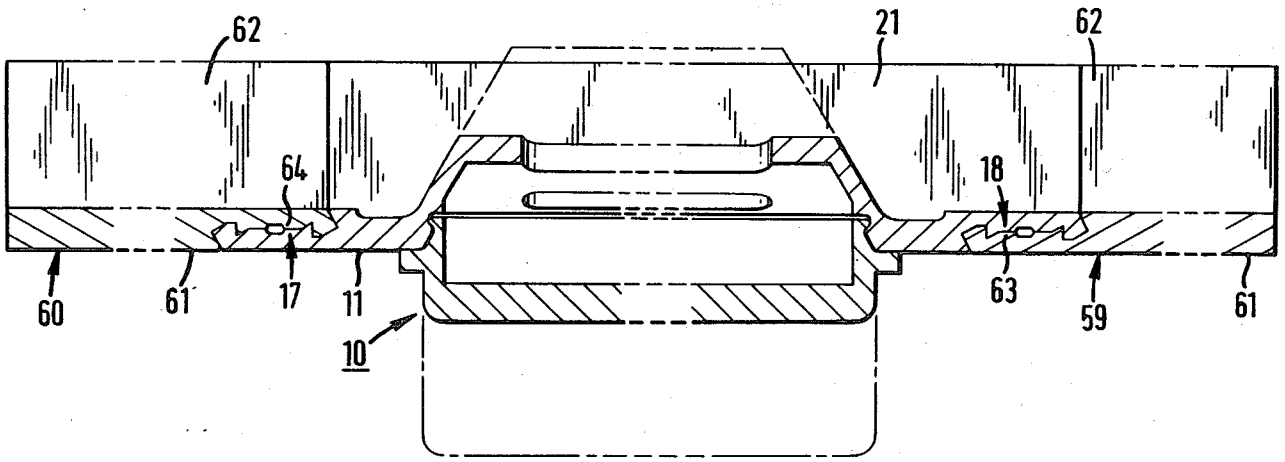
FIG. 12 is a cross section similar to FIG. 9 of connecting members connected to a component of components.

It will also be appreciated that each component 10 and corresponding slide 45 comprises a modular unit in that a plurality of identical such components 10 and corresponding slides 45 may be connected end to end to suit different sizes of window. However, where such units connected end to end are of longitudinal dimension which is less than a corresponding dimension of a window, it is necessary to use connecting members 59,60 (see FIG. 12). Each of the connecting members 59,60 comprises an elongate portion 61 of longitudinal dimension which is half of the corresponding dimension of a lamina 11 of a component 10 and of height corresponding to a lamina 11. Also, each connecting member 59,60 is provided with an integral lower channel portion 62 corresponding to a channel portion 21 of a lamina 11. However, unlike a lamina 11, each connecting member 59,60 is provided with a formation 63,64 at one end portion only. The formations 63 and 64 are complementary and correspond with the formations 19,20. Therefore, the connecting members 59 is a "right hand" connecting member and the connecting member 60 is a "left hand" connecting member.

The provision of the connecting members 59,60 enables a selection of one or more modular components 10 and one or more connecting members 59,60 to be used therewith so that any combination may be connected end to end in series to fit any size window. If necessary, one or more connecting members may require to be cut to size.

Figure 13:
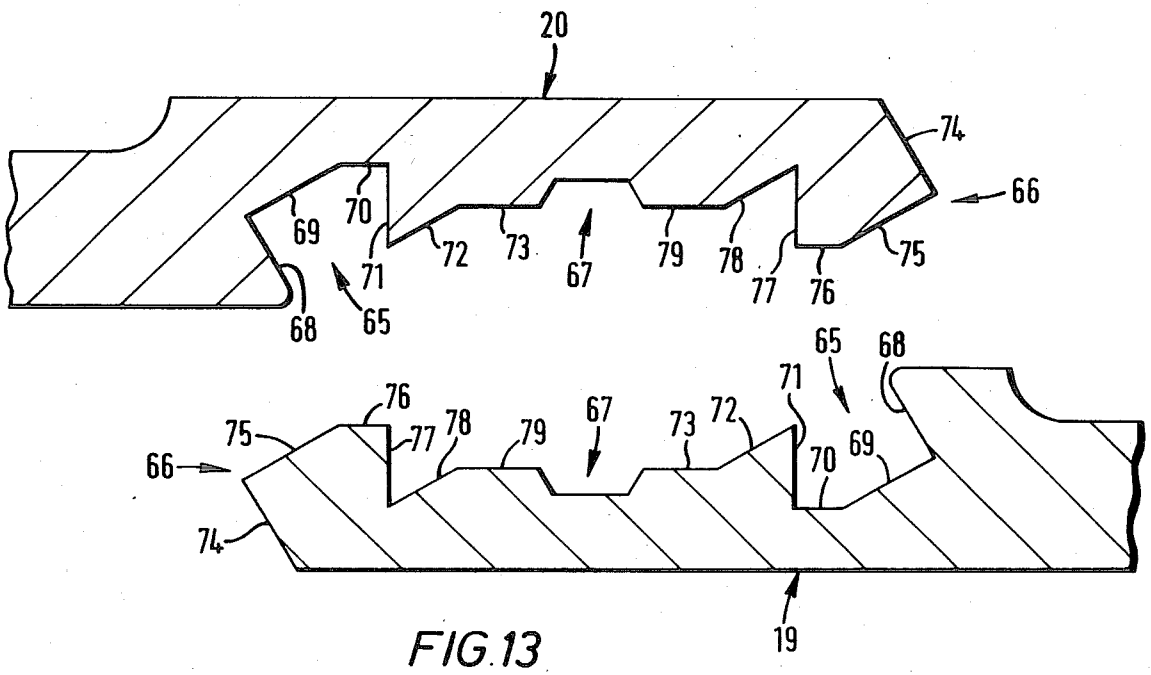
FIG. 13 is a cross section of two complementary formations.

Referring now to FIG. 13 of the drawings, there is shown, in cross section, two formations 19,20. The formation 19 comprises a recess 65 located adjacent the corresponding cowl 23, a projection 66 located remote from the cowl and a recess 67 intermediate the recess 65 and the projection 66. The recess 65 comprises an undercut wall 68, a lower wall 69 downwardly sloping therefrom to a base 70 and an upstanding side wall 71 which extends upwardly only for a portion of the height of an upper extremity of the undercut wall 68. A surface 72 adjacent the recess 65 slopes downwardly away from an upper extremity of the upstanding side wall 71 to a lower surface 73 adjacent the recess 67. The projection 66 comprises an upwardly outwardly inclined wall 74 corresponding to the undercut wall 68, an upper inwardly inclined wall 75 corresponding to the sloping wall 69, an upper surface 76 corresponding with the base 70, a downwardly extending wall 77 corresponding with the upstanding side wall 71, a rearwardly upwardly sloping surface 78 corresponding with the sloping surface 72 and an upper surface 79 corresponding with the lower surface 73. The formation 20, being identical with the formation 19, has identical surfaces indicated by corresponding reference numerals.

It will be appreciated therefore that the formations can be slid together in dovetail connecting action, the projection 66 of the formation 19 being received in the recess 65 of the formation 20 and the projection 66 of the formation 20 being received in the recess 65 of the formation 19 thereby interlocking the formations 19,20.

Figure 9:
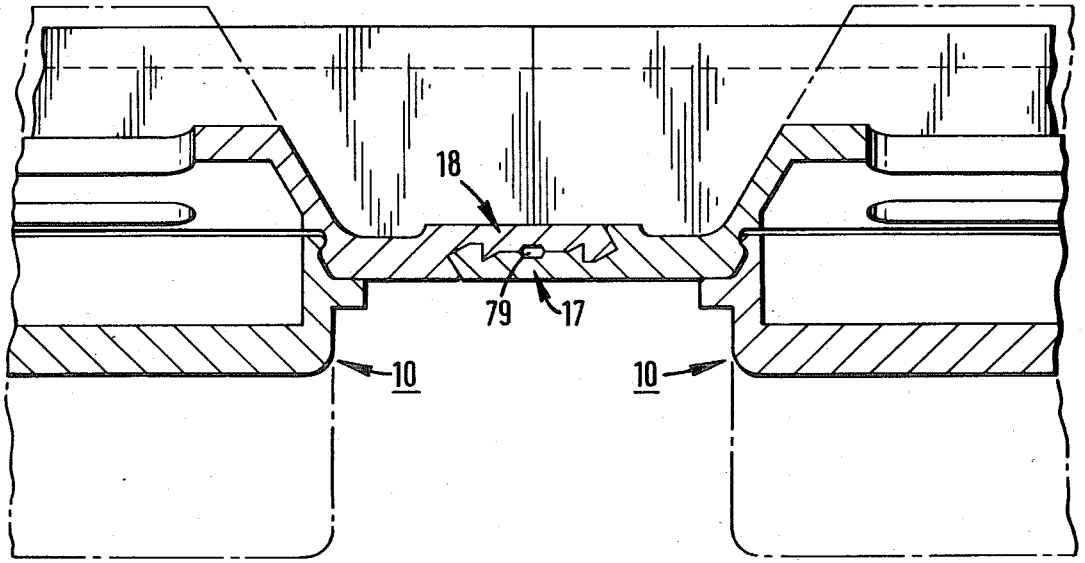
FIG. 9 is a view on the line B—B of FIG. 7.

When in the interlocking formation, the surfaces 73,79 of the formation 19 meet with the surfaces 79,73 of the formation 20 thereby providing a capillary break 79 (see FIG. 9) which prevents ingress of liquid by capillary action.

Furthermore, the configuration of the undercut wall 68, while ensuring that cooperating formations 19,20 remain in interlocking relation, also provides for the possibility of removing from a mould by "bumping" and thereby avoid the necessity of having to provide for a mould with sliding mould parts.

It will be appreciated that ventilating apparatus according to the invention may be provided with two pull cords for moving a slide 45 relative to a component 10. An end portion of one cord may be secured to a lug depending from the flange 53, which would be located at a centre of the corresponding slide 45, and the cord would extend over and downwardly from a curved flange located on the component 10 adjacent an end portion of the slide. Similarly, an end portion of the other cord may be secured to the lug and would extend over and downwardly from a curved flange located on the component 10 adjacent an opposite end portion of the slide. The free ends of the cords may be provided with tags one or each of which may be provided with a symbol indicating 'open' or 'closed'.

I claim:

1. Ventilating apparatus (10) mounted on a glazed panel (58) or the like and being in the form of a series of at least two elongate components (10, 59, 60), each elongate component comprising a body portion (11) having an inlet (39) for the passage of air therethrough, a locating device means (21) for engaging a glazed panel (58) and cowl (23) for controlling flow of air to the inlet (39) characterized in that the body portion (11) is provided with connecting means (17, 18) for connecting the body portion (11) to an identical body portion of another, identical elongate component (10, 59, 60) whereby the components (10, 50, 60) extend end to end in series, the connecting means (17, 18) of the body portion (11) being provided with a formation (19, 20) which, when connected with the said other body component (10, 59, 60) provides a capillary break (79) which prevents ingress of liquid by capillary action.

2. Ventilating apparatus as claimed claim 1 characterised in that the body portion (11) further comprises means defining a chamber (33).

3. Ventilating apparatus as claimed in claim 2 characterised in that the chamber (33) and cowl (23) are provided with complementary formations (32,44) which are interchangeable to effect location of the cowl (23) relative to the chamber (33).

4. Ventilating apparatus as claimed in claim 2 characterised in that there is further provided means (34,35) interconnecting the cowl (23) and chamber (33), and wherein the body portion (11), chamber (33), interconnecting means (34,35), the locating device (21) and cowl (23) are formed as a single component (10).

5. Ventilating apparatus (10) mounted on a glazed panel (58) or the like and being in the form of a series of at least two elongate components (10, 59, 60), each elongate component comprising a body portion (11) having an inlet (39) for the passage of air therethrough, a locating device means (21) for engaging a glazed panel (58) and a cowl (23) for controlling flow of air to the inlet (39) characterized in that the body portion (11) is provided with connecting means (17, 18) for connecting the body portion (11) to an identical body portion of another, identical elongate component (10, 59, 60) whereby the components (10, 50, 60) extend end to end in series, the connecting means (17, 18) of the body portion (11) being provided with a formation (19, 20) such as to provide for a dovetail connecting action with the said other component (10, 59, 60) and being manufactured by injection moulding without need for sliding mould parts.

6. Ventilating apparatus as claimed in claim 5 characterized in that the body portion (11) further comprises means defining a chamber (33).

7. Ventilating apparatus as claimed in claim 6 characterized in that the chamber (33) and cowl (23) are provided with complementary formations (33, 44) which are interchangeable to effect location of the cowl (23) relative to the chamber (33).

8. Ventilating apparatus as claimed in claim 6 characterized in that there is further provided means (34, 35) interconnecting the cowl (23) and chamber (33), and wherein the body portion (11), chamber (33), interconnecting means (34, 35), locating device (21) and cowl (23) are formed as a single component (10).

9. Ventilating apparatus as claimed in claim 1 or 5 characterised in that there is provided an elongate shutter (45) for controlling passage of air through the inlet (39).

10. Ventilating apparatus as claimed in claim 9 characterised in that the shutter (45) is provided with connecting means (49,54) for connecting the shutter (45) end to end in series with a shutter (45) of another similar apparatus (10) whereby operation of one of said shutters (45) effects operation of the other of said shutters (45).

11. Ventilating apparatus as claimed in (any one of the preceding claims) claims 1 or 5 characterized in that the cowl (23) is provided with an inlet (27) arranged such that the inlet (39) of the body portion is located above and to the rear of the inlet (27) of the cowl (23) thereby ensuring no direct wind pass.

12. Ventilating apparatus as claimed in claim 1 or 5 characterised in that the body portion (11), the locating device (21) and the cowl (23) are formed as a single component (10).

* * * * *